US005730058A

United States Patent [19]

Borgardt

[11] Patent Number: 5,730,058

[45] Date of Patent: Mar. 24, 1998

[54] METHOD AND APPARATUS FOR THE DRYING OF FILM LINES PRINTED IN THE OFFSET METHOD

[75] Inventor: Dëtta Borgardt, Bremervorde, Germany

[73] Assignee: Cleanpack GmbH Innovative Verpackungen, Germany

[21] Appl. No.: 823,448

[22] Filed: Mar. 24, 1997

Related U.S. Application Data

[63] Continuation of Ser. No. 519,370, Aug. 25, 1995, abandoned.

[51] Int. Cl.[6] ..... B41F 23/04

[52] U.S. Cl. ..... 101/483; 101/424.1; 101/488; 34/611

[58] Field of Search ..... 101/424.1, 424.2, 101/488, 416.1, 483; 34/95, 611; 432/59, 8

[56] References Cited

U.S. PATENT DOCUMENTS

| | | | |
|---|---|---|---|
| 3,874,091 | 4/1975 | Fukumoto | 34/66 |
| 3,962,213 | 6/1976 | Flynn | 427/224 |
| 5,141,988 | 8/1992 | Suwala et al. | 524/548 |

*Primary Examiner*—Edgar S. Burr
*Assistant Examiner*—Dave A. Ghatt
*Attorney, Agent, or Firm*—Anthony J. Casella; Gerald E. Hespos; Ludomir A. Budzyn

[57] ABSTRACT

A method and a device for the drying of a plastic foil sheet printed in the offset method which is directed through several printing stations is revealed, whereby the plastic foil is flame dried behind the last printing station in the direction of advance of the plastic foil.

6 Claims, 1 Drawing Sheet

FIG. 1
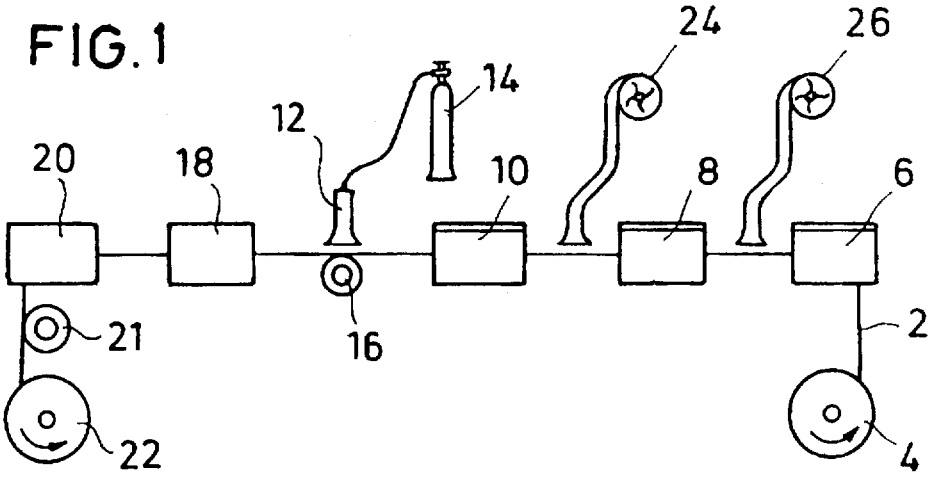
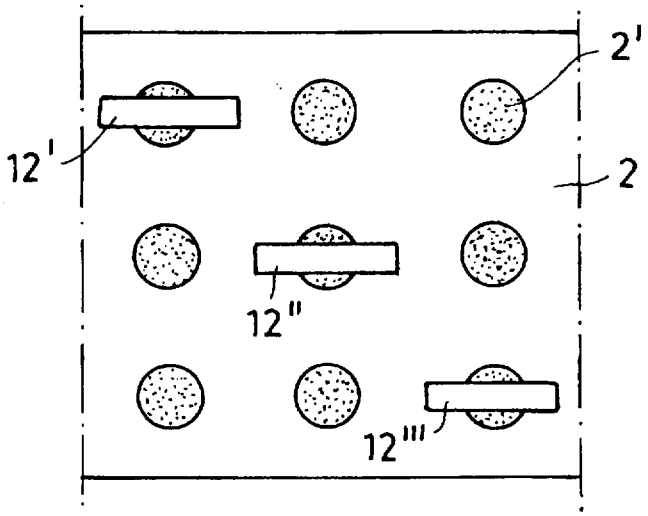
FIG. 2
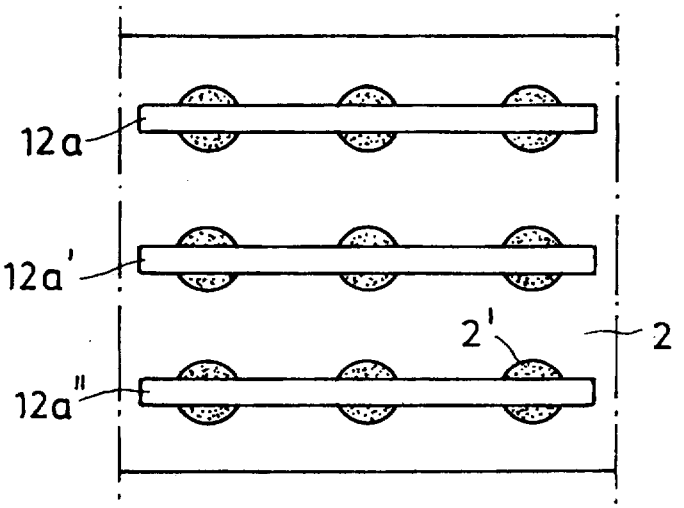
FIG. 3

METHOD AND APPARATUS FOR THE DRYING OF FILM LINES PRINTED IN THE OFFSET METHOD

This application is a continuation, of application No. 08/519,370 filed Aug. 25, 1995, now abandoned.

BACKGROUND OF THE INVENTION

1. Field of the Invention

The present invention relates to a method and device for drying film lines printed in the offset method, particularly PP (polypropylene), PS (polystyrene), and PE (polyethylene) films.

2. The Prior Art

The invention relates in particular to a method and a device for drying films printed in the rotary offset printing method whose printing ink is still wet behind the last printing station and tends to deposit or "come off."

The processing of printed film lines requires that the printing inks be dry so that the film lines can be wound up without deposits and can be further processed. Conventional methods and devices are not suitable for drying the printing inks immediately behind the last printing station so that the film lines can be wound up without smearing or deposits. In the sheet-fed offset printing machines used earlier, this problem did not exist because the individual sheets were layered over one another so that a layer of air used for drying could be effective over a longer period of time between the sheets and could dry the printing ink. In the production of large quantities of plastic caps, plastic containers and other plastic objects, it has been possible in recent time to print films on rotary offset machines since this method allows a continuous production of large quantities of film lines which were not possible, to date, in the field of offset printing.

The problem intensifies when the film lines are covered with lacquer because when the lacquer is dried, the inks which are still wet are again partially dissolved so that there may be smearing. Furthermore, there is the danger that the printing inks, which are still warm, absorb condensation/water after the lacquer coating, which then partially dissolves and smears the water-soluble paint.

SUMMARY OF THE INVENTION

The present invention is directed to a method and device for drying film lines printed in the offset method, particularly on thin plastic films such as polypropylene, polystyrene and polyethylene, which allow a direct processing of the printed film lines whereby the printing inks are effectively dried.

In the present invention, flame drying is done to the film line/plastic foil behind the last printing station, in the direction of advance of the line. The flame drying thus causes a temporary high heating of the plastic film surface and thus shock evaporation of the solvents contained in the dye application. The higher the temperature of the flame, the better and more effective the drying.

It is preferable to flame dry the plastic film line on its printed surface. This creates the advantage that only the actual printing ink on the film line is flame dried, whereas the film line itself, which consists of plastic, is only indirectly affected by the high temperature. The temperature of the flame drying is limited at the point where irreversible deformation of the film line occurs.

Furthermore, it is preferred that the film line be cooled simultaneously with or after the flame drying in the direction of advance of the line. Such a cooling of the film line prevents its deformation as a result of the effects of heat of the gas flame, reduces the danger of a deposit of condensation/water on the film line which is later to be lacquered, and above all, causes a quick solidification or cooling of the printing inks.

Furthermore, it is preferred that the cooled film line be subjected to lacquering. Lacquering prevents the risk of surface impurities or damaging effects on the film line. The actual printed sections of the film line are resistant to abrasion and covered; safe from becoming soiled.

The lacquered film line preferably is subjected to hot air drying and then cooled. The hot air drying causes a quick drying of the surface lacquer whereby the subsequent cooling contributes both to the drying of the lacquer and to an additional drying of the ink.

It is also preferred that the film line be predried by blasted air after going through a printing station. In this way, a predrying of the film line inks can be achieved between the individual printing stations which prepares them for later flame drying. It is also preferred that blasted air drying occur after each printing station.

Another preferred embodiment of the invention comprises a method for the drying of film lines printed in the offset method in which the film line is run together with a paper line and wound up with it. The paper line takes up or absorbs the wet ink present on the printed side and prevents the deposit or "coming off" of the printing ink of a wrap of the film line on the underside of the film line wrap which lies above it.

The device according to the invention to perform the method provides several printing stations whereby a flame drying station is mounted behind the last printing station in the direction of the line of advance. In this way, the flame drying according to the invention can be achieved behind the last ink printing station.

The flame drying station preferably has a gas nozzle mounted on the printed side of the film line which is arranged so that the gas flame generated is directed against the printed surface of the film line. In this way, only the printing inks are subject to flame drying in a suitable manner, whereas the areas of the film line which lie below are only indirectly affected by the heat, while the unprinted side of the film line is exposed to no direct heat at all. This prevents the danger of irreversible deformation of the film line.

In a preferred embodiment, a cooling station is mounted in the direct vicinity or behind the flame station. The cooling station causes a cooling of the temperature of the film line and thus hardening of the inks which are liquid in the heated state.

The cooling station may include a cooling roller which is mounted directly below the gas nozzle on the unprinted side of the film line. In this way, during the flame drying, a harmful heating of the film line is avoided and cooling of the film line is introduced which subsequently promotes a cooling of the hot printed surface of the film line.

A lacquering station, a hot air drying station, and a second cooling station may be mounted behind the cooling station. These stations enable application of lacquer to the printed side of the film line and subsequent hot air drying or cooling of the lacquer application which thus becomes scratch resistant.

Preferably, the gas nozzle has several segmental nozzles placed over the width of the film line in the direction of advance of the line, which cover different sections of the film line on which a printing application is to be dried.

Furthermore, it is also contemplated that for guiding the film lines, that a guide roller which has segmental wheels which touch unprinted sections of the film line on which no color has been applied, be used. In this manner, independent of the drying, it is possible to avoid contact of layers of the line which carry ink with the guide roller.

Other advantages, features, and application possibilities will become apparent in light of the present Specification, Claims and Drawings.

BRIEF DESCRIPTION OF THE DRAWING

FIG. 1 shows a principle sketch of a rotary offset printing device in which the film line is dried according to the invention.

FIG. 2 shows a view of a film line in the area of a flame drying station.

FIG. 3 shows a view of a film line with an alternative flame drying station.

BEST MODE FOR PRACTICING THE INVENTION

While this invention is susceptible of embodiment in many different forms, there is shown in the drawings and will be described herein in detail several specific embodiments, with the understanding that the present invention is to be considered as an exemplification of the principles of the invention and is not intended to limit the invention to the embodiments illustrated.

In FIG. 1, a conventional rotary offset machine is shown in which, for example, a polypropylene (PP) film ("plastic foil") 2 is pulled off a winding roller 4 and led sequentially through printing station 6, 8, 10, etc., where film line 2 is printed with different inks, for example, cyan, magenta, yellow, and black. Between printing stations 6, 8 and 10, in each case, a blasted air drying device 26 or 24 is mounted which directs a current of air at room temperature against the printed side of the film line in order to predry the film line.

A flame drying station which consists of gas nozzle 12 and gas bottle 14 connected to it, is located behind last printing station 10 in the direction of advance of the line. The flame drying station serves to flame dry the printed side of film line 2 and uses, for example, propane gas, natural gas, or city gas which delivers a gas flame with a temperature of approximately 500° C. The depth or axial length of the gas nozzle opening is approximately 1 cm maximum. The gas nozzle is mounted over the film line at a distance such that the greatest temperature considered optimum is applied to the film line at the level of the ink application.

Immediately beneath the flame drying station, a cooling station is located, mounted to the underside of the film line, which has cooling roller 16 which cools the film line at approximately 10° C. in contact with the underside of it. In this way, it is possible to dry printing inks which are still wet.

Behind cooling station 16, lacquer station 18 is located in which the complete film line 2 is coated with a protective lacquer which is intended to protect the surface from becoming soiled, destroyed, or scratched. The position of cooling roller 16 is of particular significance inasmuch as without a cooling caused by the cooling roller, the paint would dry on the lacquer sheath due to its heat.

Finally, behind lacquer station 18, hot air drying station 20 is located in which lacquered film line 2 is dried with hot air. The subsequent second cooling station 21 serves to cool the heated film line 2. Finally, film line 2, processed accordingly, is wound onto drum 22. Second cooling station 21 causes both drying of the lacquer as well as an additional drying of the ink which is located under the lacquer.

In the present example, a temperature of 400° to 50° C. was observed after the lacquer drying whereas the temperature after cooling was approximately 300° to 35° C. In addition, IR drying devices can be provided to accelerate the lacquer drying. The high temperature flame drying should be adjusted in combination with the advance rate of the film line so that permanent deformation of the film line is avoided.

Alternative preferred embodiment forms of flame drying station 12 are indicated in FIGS. 2 and 3.

In FIG. 2, is a modification of a gas nozzle which extends over the total width of film line 2. The gas nozzle is divided into three segments 12', 12", 12"' which extend over a short width, and which are mounted behind one another over a certain length and placed opposite one another over the width, for example, diagonally, such as indicated in FIG. 2. The individual gas nozzle segments 12', 12", and 12"', have a width which is dimensioned so that printing ink area 2', which is formed on film line 2, is suitably reached and covered.

Between printing ink areas 2', empty areas exist which do not need to be covered by a gas nozzle segment.

In FIG. 3, an alternative preferred embodiment form of the flame drying station is indicated in which three beam-like gas nozzles 12*a*, 12*a*', 12" which stretch over the total width of film line 2 are mounted behind one another at equal distances. In this way, a particularly effective sequential heating of the printing ink areas is achieved. This serves for the special application case of film lines with ink to be dried over a greater length.

In general, it has been found that the solvents contained in the printing inks, particularly mineral oils and such types of liquids are best expelled with impact gas flaming. Therefore, generally a single beam-shaped gas nozzle 12 extending over the total width is sufficient. Nevertheless, a convergence of the gas flame on the axial width of film line 2 should be assured so that the greatest possible temperature is achieved in the area of the film line.

The drying device according to the present invention causes drying of the inks, which are wet after print application, and particularly drying of the wet ink application before lacquer covering. Furthermore, the danger of collection of condensation/water is avoided —which would otherwise attack and dissolve the water-soluble lacquer.

It is also contemplated that film line 2, which exits behind last printing station 10, be directed together with a paper line and wound up together with it so that the paper line absorbs ink residues on the film line which are still wet—thereby substantially precluding the coming off or deposit of the ink.

The foregoing description and drawings merely explain and illustrate the invention, and the invention is not limited thereto except insofar as the appended claims are so limited as those skilled in the art who have the disclosure before them will be able to make modifications and variations therein without departing from the scope of the invention.

I claim:

1. A method of drying a plastic film line having a printed side and an unprinted side, said printed side having printing ink applied thereto by an offset printing apparatus, said printing apparatus comprising a plurality of printing stations, including a final printing station from which said plastic film line advances, said method comprising the steps of:

flame drying the printing ink by passing said printed side of film line in proximity to a flame drier after said film line passes from said final printing station;

cooling said plastic film line for preventing damage to said plastic film line during the flame drying of the printing ink;

lacquering said printed side of said plastic film line after said cooling;

hot air drying said printed side of said plastic film line after lacquering; and cooling the dried lacquering on the printed side of said plastic film line.

2. The method of claim 1, wherein the step of cooling the plastic film line for preventing damage during the flame drying comprises passing said unprinted side over a cooling roller disposed substantially in line with said flame drier.

3. The method of claim 2, further comprising the step of pre-drying the film line by blast air after printing said film line in each of said printing stations.

4. The method of claim 3, further comprising the step of bringing the plastic film line together with a line of paper and winding the plastic film line and the line of paper together.

5. A drying apparatus for use with an offset printing apparatus for printing onto a plastic film line, such that said plastic film line has a printed side and an unprinted side, said offset printing apparatus comprising a plurality of printing stations, including a final printing station for selectively printing onto said printed side of said plastic film line, said offset printing apparatus further comprising means for moving said plastic film line passed said printing stations of said offset printing apparatus, said drying apparatus comprising:

a flame drying station downstream from said final printing station, said flame drying station including a gas nozzle disposed adjacent said printed side of said plastic film line;

a cooling roller disposed substantially in said flame-drying station for contact with said unprinted side of said plastic film line during the flame drying of the printed ink;

a lacquering station disposed downstream from said cooling roller for applying a lacquer to said printed side of said plastic film line;

a hot-air drying station disposed downstream from said lacquering station for drying the lacquer; and a cooling station disposed downstream from said hot air drying station for cooling the plastic film line after the application of the lacquer.

6. The apparatus of claim 5, wherein the plastic film line has a width, said gas nozzle extending substantially over the entire width of the plastic film line.

* * * * *